US007007628B1

(12) United States Patent
Conley

(10) Patent No.: US 7,007,628 B1
(45) Date of Patent: Mar. 7, 2006

(54) WATERCRAFT AND VIEWING SYSTEM KIT

(76) Inventor: Mark Conley, 421 Emerys Bridge Rd., So Berwick, ME (US) 03908

( * ) Notice: Subject to any disclaimer, the term of this patent is extended or adjusted under 35 U.S.C. 154(b) by 0 days.

(21) Appl. No.: 10/967,999

(22) Filed: Oct. 19, 2004

(51) Int. Cl.
*B63B 35/71* (2006.01)

(52) U.S. Cl. ..... 114/347; 114/66

(58) Field of Classification Search ..... 114/66, 114/347; 441/135

See application file for complete search history.

(56) References Cited

U.S. PATENT DOCUMENTS

| | | | | |
|---|---|---|---|---|
| 4,228,751 | A * | 10/1980 | Robertson et al. | 114/66 |
| 4,840,592 | A * | 6/1989 | Anderson | 441/135 |
| 4,841,899 | A * | 6/1989 | Fleckles et al. | 114/347 |
| 6,718,905 | B1 * | 4/2004 | Peerson et al. | 114/347 |
| 2003/0217525 | A1 * | 11/2003 | Keith | 52/710 |
| 2004/0255836 | A1 * | 12/2004 | Hopkins | 114/347 |

OTHER PUBLICATIONS

Viking Kayaks, http://www.vikingkayaks.co.nz/online_form.asp, date verified by http://www.archive.org/ to be published at least as early as Feb. 14, 2004.*

Guillemot Double Sea Kayak, http://www.guillemot-kayaks.com/Building/Guillemot/Double/index.html, date verified by http://www.archive.org/ to be published at least as early as Jun. 24, 2003. □□.*

* cited by examiner

*Primary Examiner*—Andrew D. Wright
(74) *Attorney, Agent, or Firm*—Lawson & Persson PC; Michael J. Persson

(57) ABSTRACT

An improved watercraft having a viewing system, and a kit for installing a viewing system in an existing watercraft. The watercraft includes a viewing opening through a portion of the bottom of the hull and a viewing system is attached thereto. The viewing system includes a substantially transparent viewing window that is disposed within the viewing opening, an attachment that attaches the viewing window to the bottom of the hull and a seal that creates a watertight seal between the viewing window and the bottom of the hull. The kit includes the components of the viewing system and a template for marking the hull of the watercraft.

27 Claims, 7 Drawing Sheets

WATERCRAFT AND VIEWING SYSTEM KIT

FIELD OF THE INVENTION

The present invention relates to the field of watercraft and, in particular, to watercraft through which the water underneath the watercraft may be viewed.

BACKGROUND OF THE INVENTION

Kayaking has become an extremely popular recreational activity. In fact, over 1 million kayaks are sold annually and it has been estimated that over ten million people paddle a kayak each year. Although kayaks have traditionally been associated with the adrenaline pumping running of white-water rivers, the vast majority of today's paddlers do so in the relatively still water of ocean bays, ponds and lakes. In still water, kayaks provide paddlers with the ability to explore areas that may not be otherwise accessible by other craft, to quietly approach birds and other wildlife, and to otherwise enjoy a unique view of their natural surroundings. However, paddlers of traditional kayaks have heretofore been unable to view the diverse and beautiful natural environment that lies underneath them.

The inventor of the present invention is avid paddler who owns a number of conventional kayaks and uses them to explore the waters off of the coast of Maine and the many lakes and ponds in the Lakes Region of New Hampshire. Because the inventor is also a marine biologist, he recognized that he was missing fully half of what he could be seeing from his kayak. Therefore, he searched for commercially available kits in order to retrofit his existing kayaks, but was dismayed to find that non were available. In response, he undertook development of the present invention, which resulted in installation of his first prototype in one of his kayaks.

This first version of the present invention used a single round pane of one-eighth inch thick LEXAN® plastic that was secured within a hole cut in the bottom of the kayak forward of the kayak's seat through the use of bolts and silicone sealing compound. This version worked reasonably well and proved to the inventor that such a viewing system could open up a whole new world to paddlers if they were able to easily and inexpensively install such a viewing window in their kayak. In addition, those first glimpses downward caused the inventor to see a whole new set of possibilities for the invention than merely sightseeing. For example, he recognized that such an invention would have great applicability to other marine biologists, fishery managers and environmental engineers in their work. However, in order to realize the full potential for these users, he recognized that there must be some way to photograph what was being viewed for later comparison with earlier photographs.

Unfortunately, the inventor's initial attempts at underwater photography resulted in poor quality due to the glare off of the top surface of the viewing Window. In response, he developed the first iteration of the camera mounting system described in detail below in order to block out the glare. This produced excellent photographs, but prevented him from concurrently viewing and photographing the underwater environment at the same time. The need to produce a kit that could be easily and inexpensively installed in existing kayaks, that would produce high quality photographs, and that would allow the paddler to view the underwater environment while taking photographs, led to further development of the viewing system that eventually resulted in the completion of the preferred embodiment described in detail below.

It is recognized that glass bottom boats have been in existence for many years, and the inventor is aware of the fact that "party boat" operators in tropical locations use them extensively. Therefore, it is understood that the concept of viewing the underwater environment through the bottom of a watercraft is not a new one. However, "glass bottoms" have typically only been installed in larger watercraft and their installation has required extensive engineering and reconstruction of the vessel hulls in order to form a water-tight seal and maintain the hull's structural integrity. For this reason, underwater viewing systems have only been installed in a relatively small percentage of watercraft.

A number of patents are directed to providing underwater viewing capabilities to smaller craft. However, none are capable of being easily an inexpensively installed in the millions of existing solid bottom kayaks, canoes and other small craft. Further, each has specific drawbacks that make them inappropriate for widespread installation in new watercraft.

U.S. Pat. No. 5,337,692, titled "Transparent Bottom Boat" discloses a recreational boat with a viewing plane that is inserted into a preformed portion of the hull and secured thereto. This patent disclosed a boat having a bottom through which underwater environment may be viewed. However, the design requires that the watercraft be specifically manufactured to include this feature, making it unsuitable for retrofitting of existing watercraft. Further, the fact that the entire bottom surface is transparent makes scratching of the viewing area by the user unavoidable and vastly reducing the effectiveness of the viewing area.

U.S. Pat. No. 6,394,020, tilted "Transparent Kayak/Canoe Hull", describes a combination canoe/kayak hull unitarily formed from seamless thermoplastic and dimensioned for use either as a canoe or kayak depending upon the use of trimming weights. This patent disclosed a kayak having a bottom through which underwater environment may be viewed. However, as was the case with U.S. Pat. No. 5,337,692, this design requires that the vessel be specifically manufactured to include this feature, making it unsuitable for retrofitting of existing kayaks and includes an entire bottom surface that is transparent, making scratching of the viewing area by the user unavoidable and vastly reducing the effectiveness of the viewing area.

U.S. Pat. No. 6,745,716, tilted "Modular Kayak", discloses a design that combines the features of U.S. Pat. Nos. 5,337,692 and 6,394,020. In this patent, the kayak includes interchangeable central hulls having different configuration. In one embodiment, the removable cockpit is transparent. However, as was the case with the above described configurations, the transparent hull of this patent is not adapted for the retrofitting of existing kayak's and is prone to scratching.

Therefore, there is a need for a watercraft having a viewing system that allows high quality photographs to be taken at the same time as the paddler views the underwater environment and that does not need to be stepped upon by the user and, therefore, is not prone to scratching, and a kit that allows a viewing system to be easily and inexpensively installed in existing kayaks and other watercraft.

SUMMARY OF THE INVENTION

The present invention is an improved watercraft having a viewing system and a kit for installing a viewing system in an existing watercraft.

In its most basic form, the watercraft includes a hull having a top, a bottom, an inside surface, an outside surface, a bow portion, and a stern portion. At least one paddler opening is disposed through the top of the hull and at least one viewing opening is disposed through the bottom of the hull. The paddler opening is dimensioned to allow a paddler to pass through the opening and sit such that his lower extremities are in contact with the inside surface of the bottom of the hull, and also such that the paddler may look downward and see a viewing area formed on the bottom of the hull proximate to his lower extremities. The viewing opening is disposed through a portion of the viewing area of the bottom of the hull and the viewing system is attached thereto. The viewing opening may be cut from the fully formed hull of the kayak, or may be molded into the bottom of the kayak during the molding process. The viewing system includes a substantially transparent viewing window that is disposed within the viewing opening. An attachment means attaches the viewing window to the bottom of the hull and a sealing means creates a watertight seal between the viewing window and the bottom of the hull.

The preferred viewing window has a substantially oblong shape and is dimensioned to form a viewing portion and a photographic portion over which a photographic hood may be disposed. The photographic hood preferably includes a camera mount for mounting a camera and a camera shutter control is preferably provided for remotely controlling the operation of a shutter of the camera. In some embodiments, the camera shutter control includes a foot pedal mounted on the inside surface of the bow portion of the hull at a location accessible to a foot of the human paddler. However, other embodiments utilize different controls, or eliminate the camera shutter control completely.

The preferred watercraft is a kayak that also includes at least one light disposed thereon so as to illuminate an area below the viewing window. In embodiments utilizing a camera mount and camera shutter control, the light is preferably in communication with the camera shutter control and is energized when the camera shutter control is activated in the same manner is remote flash bulbs are operated by commercial photographers. However, other embodiments utilize a light, or lights, in order to enhance the view through the viewing window, while still others eliminate the light completely.

The viewing window of the kayak preferably includes different coatings disposed upon its top and bottom surfaces thereof. In some such embodiments, these coatings are be similar to those used in conventional diving masks, which cover both surfaces and may be varied to provide different effects. In other embodiments, a glare reducing coating is disposed upon the top surface of the viewing window, while in still others the coatings are eliminated completely.

In the preferred embodiment of the kayak, the viewing window is dimensioned to overlap a first portion of the inside surface of the bottom of the hull surrounding the viewing opening and the sealing means is a compressible closed cell rubber gasket dimensioned to overlap the viewing window, the first portion and a second portion of the inside surface of the bottom of the hull surrounding the at least one viewing opening. In this embodiment, the attachment means is made up of a substantially rigid compression member manufactured of high molecular weight polyethylene that is disposed over the gasket and dimensioned to compress the gasket, a plurality of threaded mounting bolts, and a plurality of mounting nuts dimensioned to mate with the mounting bolts. The compression member, gasket, and the bottom of the hull surrounding the at least one viewing opening each have bolt openings disposed therethrough at locations such that the openings form substantially continuous cylindrical bores and the mounting bolts are disposed through the cylindrical bores and secured by the mounting nuts, which are tightened such that the compression member compresses the gasket. However, it is recognized that a number of other attachment means and sealing means may be utilized to achieve similar results. For example, the preferred viewing window may be both attached and sealed using a marine grade sealing adhesive. Further, in embodiments utilizing round viewing windows, porthole or bulkhead fittings, such as those typically use to form on marine portholes, may be utilized. These fittings typically include a top flange, a bottom flange, a plurality of gaskets, and a locking ring that all thread together to seal the viewing window in place within the viewing opening.

Finally, in embodiments in which the watercraft is a kayak, the kayak need not be a single person kayak and, in some embodiments of the invention, the kayak includes a plurality of paddler openings and a corresponding number of viewing openings.

The basic kit for forming a viewing system in a watercraft includes all of the parts of the viewing system discussed above, as well as a template for marking the bottom of the hull to allow the removal of the viewing opening. During assembly, the user will sit in their usual position within the watercraft and secure the template to the bottom in a location that provides maximum viewing area between the user's legs. The user will then mark the bottom of the watercraft using the template, remove the viewing opening from the bottom, and install the viewing system therein.

Therefore, it is an aspect of the invention to provide a watercraft having a viewing system that allows a paddler to view the underwater environment.

It is a further aspect of the invention to provide a watercraft having a viewing system that allows a paddler to take high quality photographs at the same time as the he views the underwater environment.

It is a further aspect of the invention to provide a watercraft having a viewing system that that does not need to be stepped upon by the user and, therefore, is not prone to scratching.

It is a further aspect of the invention to provide a kit that allows a viewing system to be easily and inexpensively installed in existing watercraft.

It is a further aspect of the invention to provide a watercraft, viewing system and kit in which the viewing window may be easily and inexpensively replaced.

It is a still further aspect of the invention to provide a watercraft, viewing system and kit in which different viewing windows and/or light filters may be used to enhance visibility under different viewing conditions.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1A:
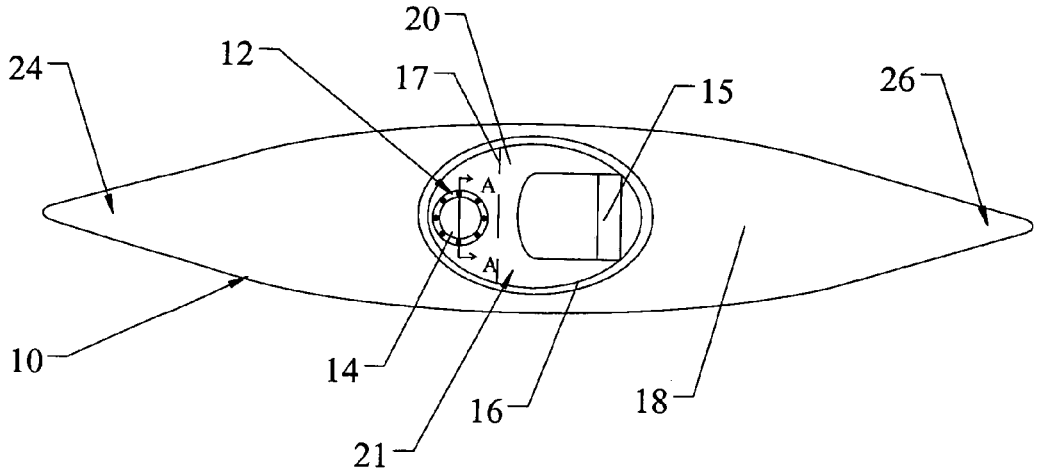
FIG. 1A is a top view of one embodiment of the watercraft of the present invention showing a kayak having a paddler opening and viewing opening.
Figure 1B:
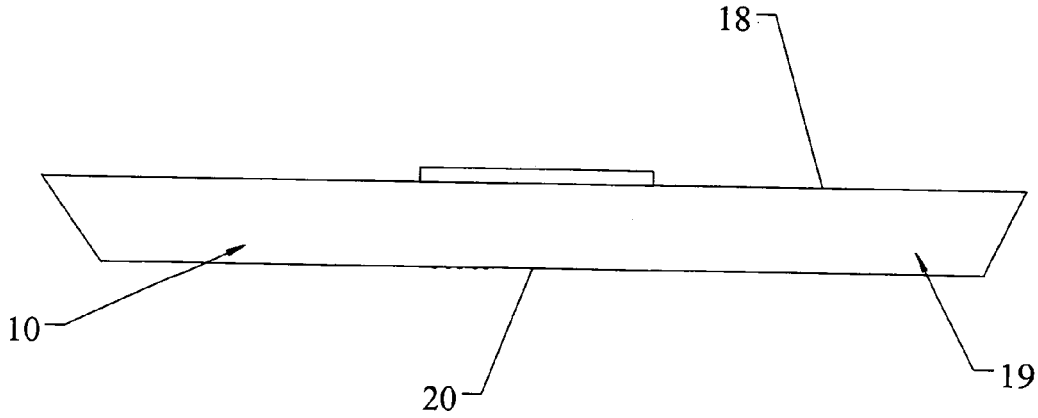
FIG. 1B is a side view of the embodiment of the kayak of FIG. 1A.

Referring first to FIGS. 1A and 1B, one embodiment of the watercraft of the present invention is shown. The preferred watercraft is a kayak 10 that includes a hull 11 having a top 18, a bottom 20, an inside surface 21, an outside surface 19, a bow portion 24, and a stern portion 26. At least one paddler opening 16 is disposed through the top 18 of the hull 11 and a seat 15 is preferably disposed within the paddler opening 16 to allow the buttocks of the paddler to be maintained above the bottom 20 of the hull 11. The kayak 10 shown in FIGS. 1A and 1B is a typical whitewater kayak design insofar as it is shorter in length, has a substantially centrally disposed paddler opening 16 and a central portion 13 that it substantially wider than the bow portion 24 and stern portion 26. However, it is recognized that kayak 10 of the present invention may utilize other art recognized kayak designs, such as those used for sea kayaks, touring kayaks, or the like and, therefore, the kayak 10 of the present invention should not be viewed as being limited to the designs shown herein.

The primary difference between the kayak 10 of the present invention and those of the prior art is the inclusion of at least one viewing opening 14, disposed through the bottom 20 of the hull 11, to which the viewing system 12 is attached. The viewing system 12 includes a substantially transparent viewing window 32 that is disposed within the viewing opening 14. As described in detail below with reference to FIGS. 2A and 2B, the viewing window 32 is attached to the bottom 20 of the hull 11 by an attachment means 34 and sealed by a sealing means 36, which creates a watertight seal between the viewing window 32 and the bottom 20 of the hull 11.

Figure 2A:
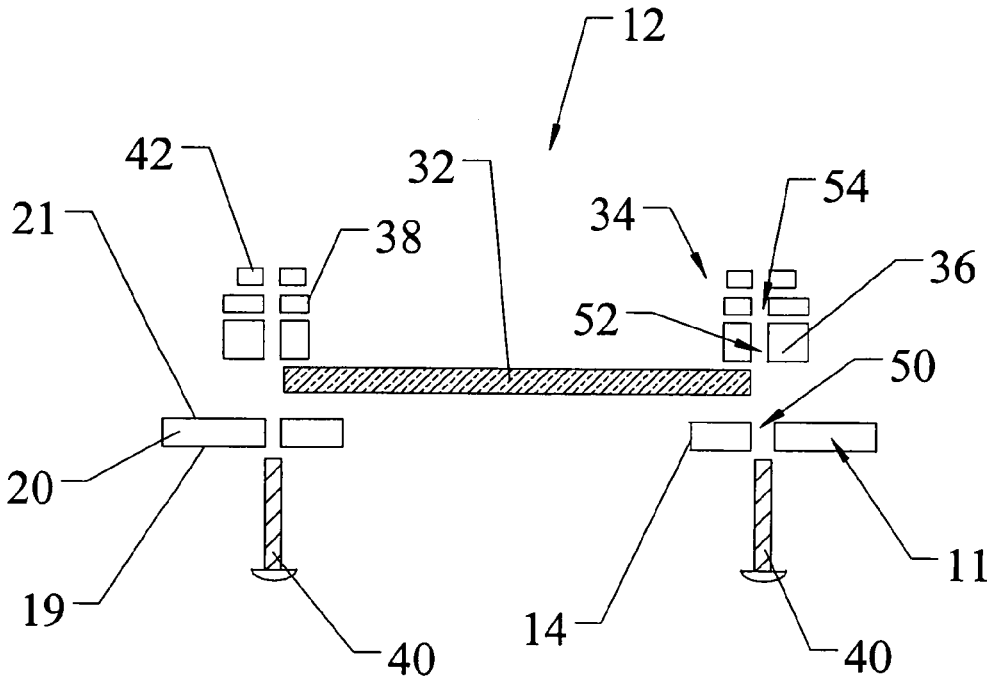
FIG. 2A is a partial cross sectional view of the kayak and viewing system of FIG. 1 taken along section A—A with the viewing system ready for assembly.
Figure 2B:
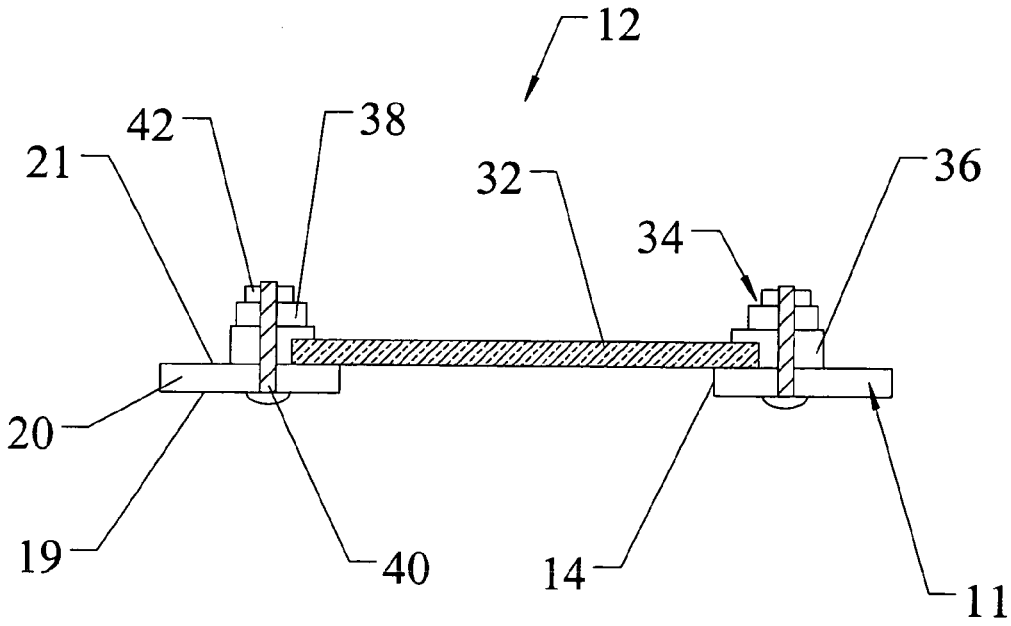
FIG. 2B is a partial cross sectional view of the kayak and viewing system of FIG. 1 taken along section A—A with the viewing system assembled.

In the embodiment of FIGS. 2A and 2B, the viewing window 32 of the viewing system 12 is disposed against the inside surface 21 of the bottom 20 of the hull 11 such that the viewing window 32 completely covers the viewing opening 14 and such that a substantially equal amount of the viewing window 32 overlaps a first portion 46 of the bottom 20 of the hull 11 proximate to the viewing opening 14. As shown in FIGS. 2A and 2B, the viewing window may simply sit in this position and be held in place solely by the attachment means 34. However, in other embodiments the viewing window may be attached to the inside surface 21 of the bottom 20 of the hull 11 by a marine adhesive, silicone caulking compound, or other compound commonly used in the marine and/or glazing arts for attaching glass or transparent plastic to a mating plastic or fiberglass surface.

The viewing window 32 may be manufactured from a variety of transparent materials, such as glass or substantially clear plastic and, may be coated with a variety of different coatings. In the preferred embodiment, the viewing window 32 is manufactured of tempered glass to which a glare resistant top coating and an image enhancing bottom coating, such as those typically found in diving masks, are applied. However, other embodiments utilize LEXAN® type plastic, which may be manufactured using additives to provide the desired optical properties. In still other embodiments, the viewing system includes filter mounts proximate to the top and/or bottom surface of the viewing window 32 to allow various optical filters to be attached thereto.

Regardless of the material used to manufacture the viewing window 32, the preferred viewing window 32 is substantially flat and provides no magnification of the area under the kayak 10. However, in some embodiments, the viewing window 32 is shaped in order to magnify the area under the kayak 10. This is accomplished in much the same manner as eyeglass lenses are formed, with different levels of magnification being achievable by forming surfaces with different levels of concavity. It is noted that this is not preferred due to the narrower field of vision produced thereby and the risk of distortion caused by the differences in focal lengths for users of different heights. Therefore, in embodiments in which magnification is desired, a handheld magnifier (not shown) may be utilized. The preferred magnifier has a suction cup end that attaches to the viewing window, a telescoping body, similar in form and function to those found in photographic zoom lenses, and an eyepiece adapted for placement over the user's eye.

The preferred kayak 10 also includes a skirt 17 that extends at least part way over the paddler opening 16. The skirt 17 is similar to skirts commonly used in conventional kayaks to prevent water from entering the paddler opening 16, but differs in that it does not surround the paddler. Rather, the skirt 17 of the kayak 10 of the present invention extends part way across the front portion of the paddler opening 16 such that the paddler may still view the viewing assembly 12 with the skirt engaged. Such a skirt 17 is advantageous as it helps to eliminate water droplets from the paddle from accumulating on the viewing window 14 and assists in blocking sunlight that can cause glare when reflected off the top surface of the viewing window 14. However, although the use of such a skirt 17 is preferred, it is recognized that embodiments that do not utilize such a skirt 17 will achieve similar results.

In the embodiment of FIGS. 2A and 2B, the sealing means is a gasket 36 manufactured from a compressible gasketing material, preferably closed cell NEOPRENE® rubber foam, that has a substantially uniform thickness and is dimensioned to overlap the edge of the transparent viewing window 32 and a second portion 48 of the inside surface 21 of the bottom 20 of the hull 11 a sufficient distance to create a substantially watertight seal when compressed by the attachment means 34. Such a gasket 36 is preferred in applications for use with kayaks having substantially flat bottoms due to its low manufacturing cost. However, in embodiments adapted for use with kayaks having shaped bottoms, the gasket 36 is not of uniform thickness but rather is formed to surround the viewing window and mate with the curved bottom, effectively sealing the window in place.

Finally, in the preferred embodiment, a marine grade sealant, such as marine grade silicone, or the like, is disposed between all mating surfaces and in all through holes prior to installation to provide an additional sealing means.

In the embodiment of FIGS. 2A and 2B, the attachment means 34 is made up of a substantially rigid compression member 38 that is disposed over the gasket 16 and dimensioned to compress the gasket 36, a plurality of threaded mounting bolts 40, and a plurality of mounting nuts 42 dimensioned to mate with the mounting bolts 40. The compression member 38 is preferably manufactured of an ultra high molecular weight polyethylene (UHMW) due to its rigidity, corrosion resistance, light weight, and ready manufacturability. However, it is recognized that other substantially rigid materials may be substituted, provided they produce the substantially even compression of the gasket that is necessary to produce a watertight seal.

In the preferred embodiment, the compression member 38, gasket 36, and the bottom 20 of the hull 11 surrounding the viewing opening 14 each have bolt openings 54, 52, 50, respectively, disposed therethrough at locations such that the openings 54, 52, 50 form substantially continuous cylindrical bores when aligned as shown in FIGS. 2A and 2B. Once the viewing window 32, compression member 38, and gasket 36 are properly aligned with the bottom 20 of the hull 1, the mounting bolts 40 are disposed through the openings 54, 52, 50 and secured by the mounting nuts 42. The mounting nuts 42 are then tightened such that the compression member 38 compresses the gasket 36 against the viewing window 32 and the second portion 48 of the inside surface 21 of the bottom 20 of the hull 11 until a watertight seal is formed. The preferred attachment means also includes a plurality of fender washers (not shown), which are disposed between each bolt head and the bottom 20 of the hull 11 to evenly distribute the bolt compression forces along the hull 11.

Although the preferred embodiment of the viewing system 12 utilizes the attachment means 34 and sealing means 36 described above, it is recognized that a number of other attachment means 34 and sealing means 36 may be utilized to achieve similar results. For example, the viewing window 32 may be both attached and sealed using a marine grade sealing adhesive. This arrangement is not preferred due to the strength limitations of many common marine grade sealing adhesives, the fact that the failure of the seal between the viewing window 32 and the hull 11 during use would likely result in the kayak sinking, and the fact that the permanence of such an installation makes replacement of the viewing window difficult or impossible in the event that the viewing window is damaged.

Figure 5:
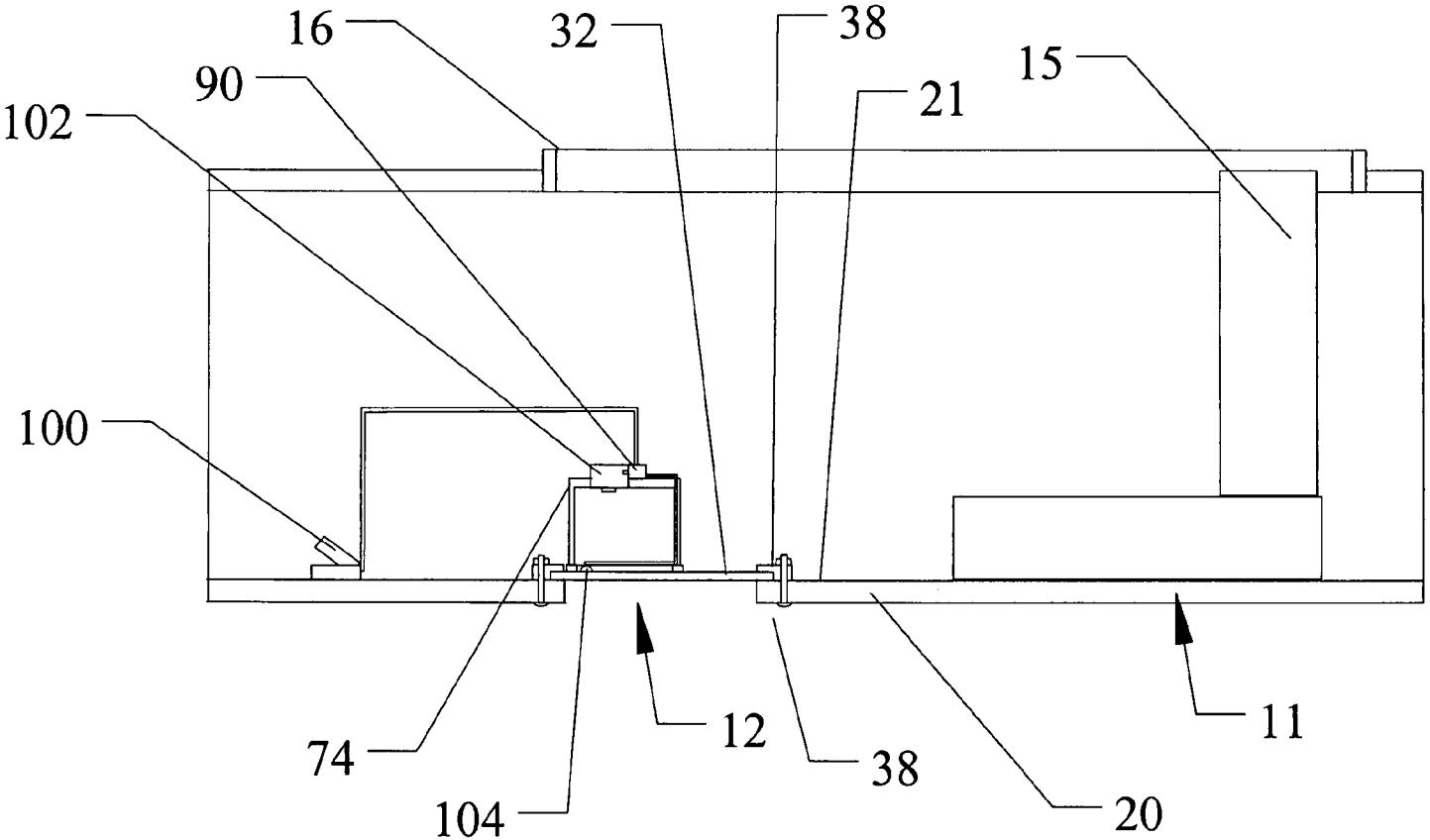
FIG. 5 is a cut away side view of one embodiment of the kayak having a viewing system with a photographic hood, foot actuated camera shutter control, and light.

In other embodiments, such as the embodiment shown in FIG. 5, a marine grade adhesive or caulking compound may be used in place of the gasket 36 as the sealing means in the arrangement of FIGS. 2A and 2B. In these embodiments, the compression member 38 is dimensioned to conform to the edge of the viewing window 32 and the inside surface 21 of the hull, taking a shape similar to the compressed gasket 36 of FIG. 2B, and the adhesive or caulking compound is disposed upon both the viewing window 32 and compression member 38 to provide a watertight seal. In such embodiments, the compression member 38 should not be manufactured of UHMW, as UHMW is a non-polar and will not effectively bond with the adhesive or caulking compound, and materials such as fiberglass or bondable plastics should be used. In these embodiments, the use of the compression member 38 eliminates the safety concerns in embodiments utilizing only adhesives. However, in embodiments utilizing a marine adhesive, this arrangement likewise creates a permanent attachment, again limiting the ability to remove and replace the viewing window.

Regardless of what attachment means and sealing means are utilized, it is preferred that all materials used in the viewing assembly 12 be manufactured of substantially non-corrodible materials that will withstand both a salt-water environment and ultraviolet radiation. Accordingly, all metallic parts are preferably manufactured of stainless steel and all non-metal parts are manufactured of material that is not degradable by the sun's ultraviolet radiation.

As shown in FIGS. 1A, 1B, the viewing window 32 is substantially round in shape. As noted below, embodiments having round viewing windows 32 are not preferred, as this shape does not lend itself to concurrent viewing and photographing of the area below the kayak 10. However, embodiments having round viewing windows 32 have a number of advantages that make this shape an excellent option in many circumstances. For example, in embodiments utilizing round viewing windows 32, the attachment means 34 and sealing means 34 may take the form of a standard porthole fitting (not shown).

Figure 3:
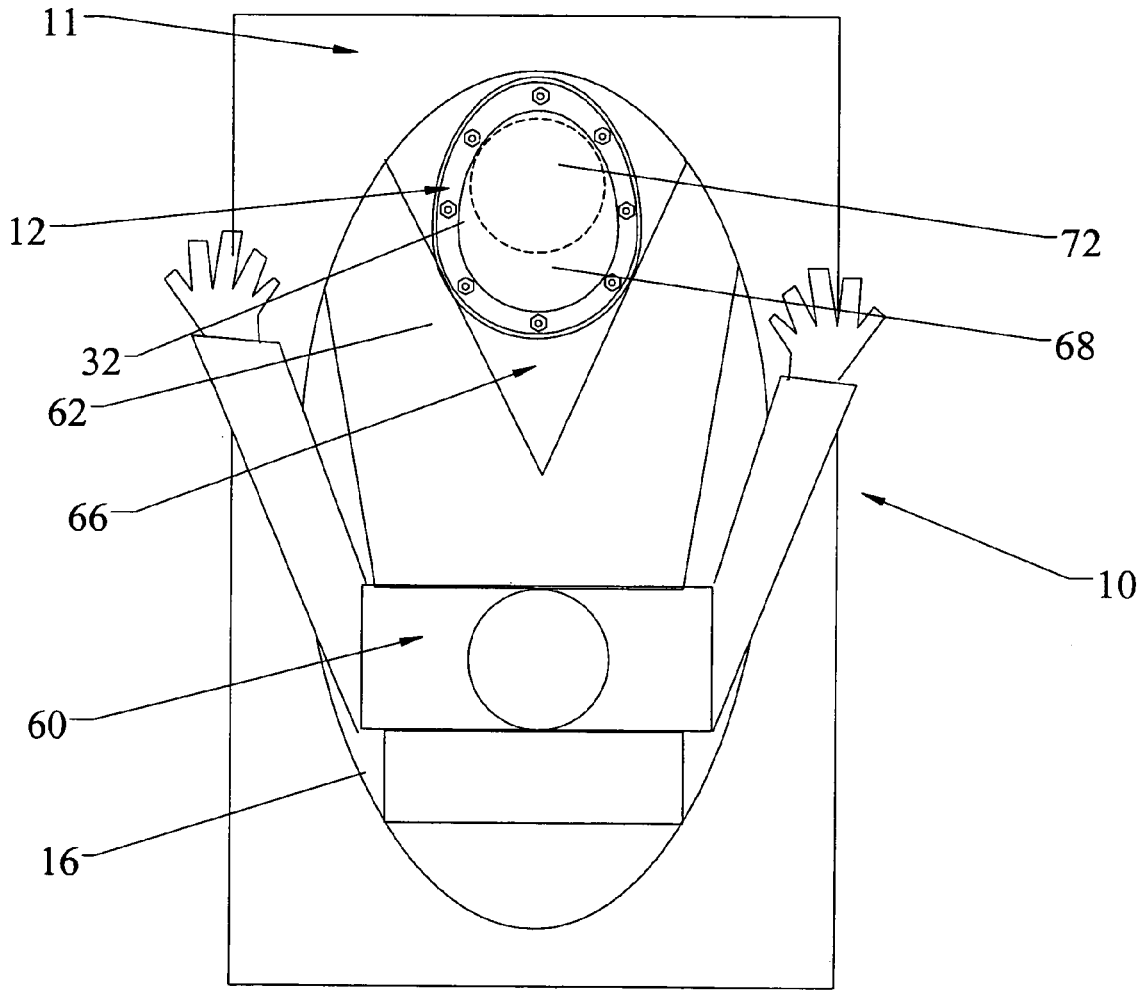
FIG. 3 is a top view of the preferred kayak of the present invention with the bow portion and stern portion removed, the viewing system mounted to the bottom of the hull, and a paddler seated in the seat.

Referring now to FIG. 3, the paddler opening 16 is dimensioned to allow a paddler 60 to pass through the opening 16 and sit such that his legs 62 are in contact with the inside surface 21 of the bottom 20 of the hull 11 and such that the paddler may view the area formed on the bottom 20 of the hull 11 between his legs 62, referred to herein as the viewing area 66 formed on the bottom of the hull proximate to his lower extremities. The viewing opening is disposed through a portion of the viewing area 66 of the bottom 20 of the hull 11 and the viewing system 12 is attached thereto. As shown in FIG. 3, the preferred viewing system 12 includes a viewing window 32 that has a substantially oblong shape and is dimensioned to form a viewing portion 68 and a photographic portion 72, denoted by dashed lines, over which a photographic hood (shown in FIG. 4) may be disposed. The use of an oblong viewing window 32 is preferred as it allows the paddler 60 to view the area below the kayak 10 and concurrently take photographs thereof. As noted above, the ability to concurrently view and photograph the water column below the kayak 10 is important to marine biologists and environmental engineers. However, this ability will appeal to recreational paddlers 60 as well.

Figure 4A:
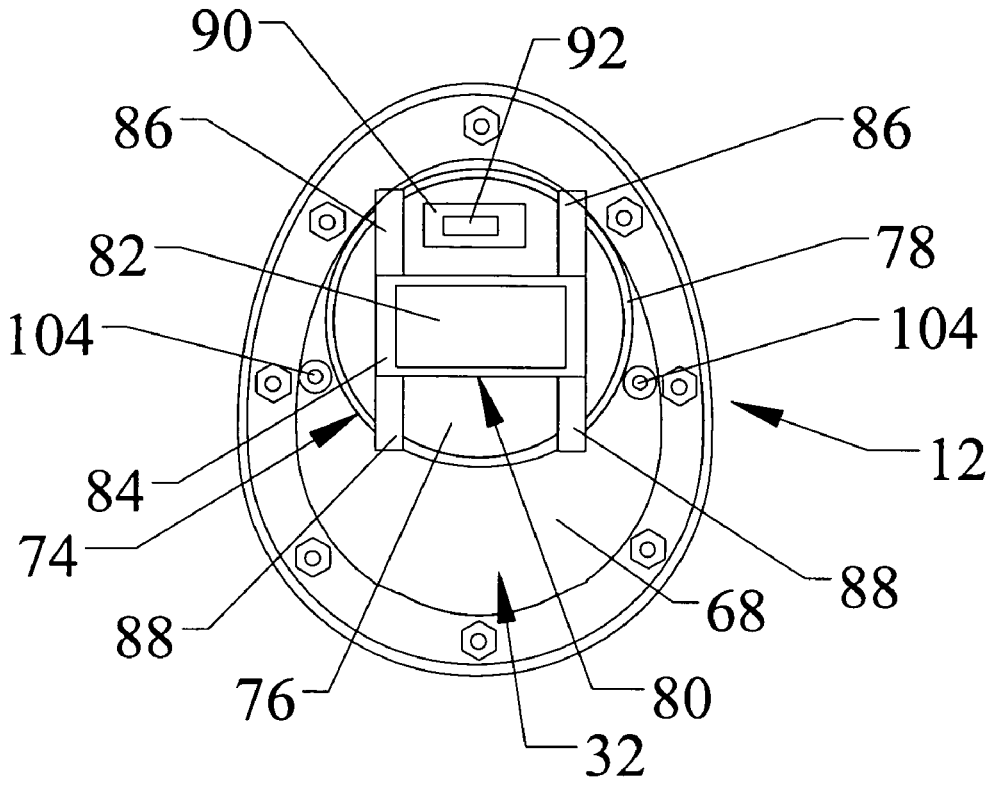
FIG. 4A is a top view of the preferred viewing system upon which is mounted a photographic hood, camera mount and camera shutter control.
Figure 4B:
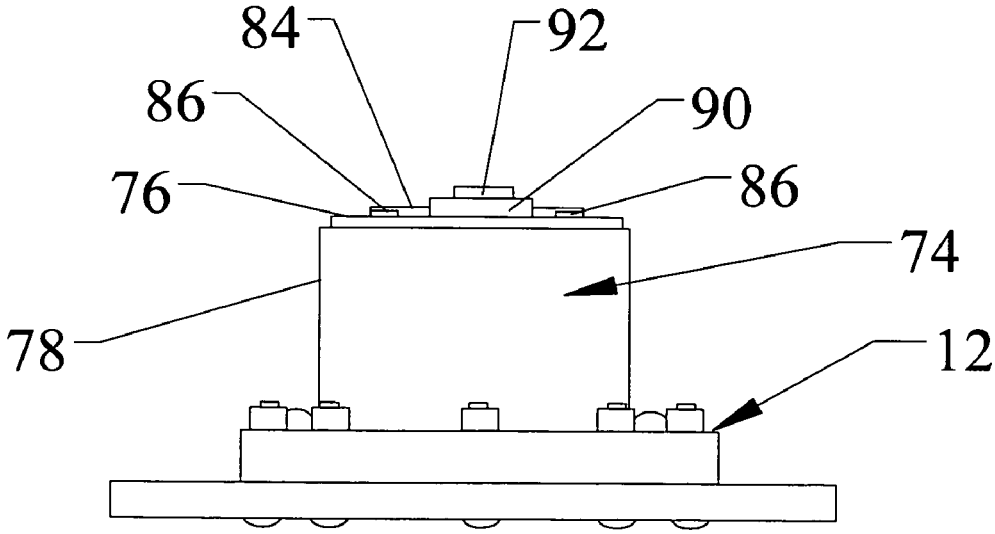
FIG. 4B is a side view of the viewing system of FIG. 4A.

Referring now to FIGS. 4A and 4B, the viewing system 12 is adapted for use with a photographic hood 74, which acts to eliminate any glare from light reflected from viewing window 32 that could affect the quality of the photographs taken therethrough. The photographic hood 74 is preferably cylindrical in shape and includes a side wall 78 having a bottom that includes a gasket, suction cup or other material, adapted to mate with the surface of the viewing window and block all light from above the kayak from entering the hood, an open top, and a top plate 76 attached to the open top formed by the side wall 78. The top plate 76 includes a camera mount 80 for mounting a camera (shown in FIG. 5) thereto. In the embodiment of FIGS. 4A and 4B, the camera mount 80 includes a camera opening 82 sized to be slightly smaller than the body of the camera, a flexible sealing member 84 that is disposed around the periphery of the camera opening 84, and a pair of hook and loop fasteners made up of a hook portion 86 and loop portion 88 mounted proximate to the sealing member 84. In operation, the camera is aligned with the camera opening 84 with the camera lens pointing toward the viewing window 32 and placed upon the sealing member and the hook portions 86 and loop portions 88 are mated together to hold the camera body in place.

Although a relatively simple camera mount 80 is shown in FIGS. 4A and 4B, it is recognized that a number of other embodiments of the camera mount 80 could be used. For example, the camera mount 80 may include a substantially circular opening through which only the lens of an SLR type camera may be disposed and a screw mount, similar to those used on conventional camera tripods, could secure the camera body to the top plate 76. Similarly, the camera mount 80 may include a suction cup (not shown) that has a male threaded portion that is adapted to mate with the female threaded filter boss on the end of most conventional SLR camera lenses. In this embodiment, the mount 80 is threaded onto the lens and the suction cup secured to the viewing window.

The viewing system 12 may also include a camera shutter control 90 that is adapted for connection to the camera such that the camera may be controlled thereby. As shown in FIGS. 4A and 4B, the camera shutter control 90 may be mounted on the top plate 76 of the photographic hood 74, allowing the paddler to take a photograph by merely depressing the button 92 thereon. Because access to the camera's integral shutter control may be obscured by the camera mount 80 in some embodiments, such as those shown in FIGS. 4A and 4B, the use of such a separate camera shutter control 90 is preferred in such embodiments. However, it is recognized that other embodiments may not include such a camera shutter control 90. Further, the camera shutter control 90 may take a different form. For example, the camera shutter control 90 may include a remote control, such as the foot-actuated control 100 shown in FIG. 5. The foot-actuated control 100 of FIG. 5 serves the same purpose of the button 92, i.e. to actuate the camera shutter, but allows this to be accomplished without the paddler taking his hands off of the kayak paddle in order to do so. Similarly, in other embodiments, the camera shutter control 90 is a radio signaled control that is actuated by a button on the paddle (not shown). In both such embodiments, the remote cameras shutter control allows the paddler to continue paddling while taking photographs, greatly simplifying the process and reducing the risk that the paddler will inadvertently loose his paddle while taking photographs.

The embodiments of FIGS. 4 and 5 also include a pair of suction cup style marine lights 104 that is mounted to the viewing window 32 thereon so as to illuminate an area below the bottom viewing window 32. It is not required that the light 104 include suction cups for mounting to the viewing window 32 and, in some embodiments, the light may be a commercially available waterproof marine type underwater light that is mounted elsewhere on the bottom 20 of the hull 11, provided the light is capable of illuminating the area below the viewing window 32.

The light 104 of the embodiment of FIG. 5 is in communication with the camera shutter control 90 and is energized when the camera shutter control 90 is activated; operating in the same manner is remote flash bulbs used by commercial photographers. This arrangement is preferred as it prevents the illumination of the light 104 from scaring marine life that may be present under the bottom of the kayak 10. However, in other embodiments the light 104 is operated separately from the camera shutter control 90, allowing the view through the viewing opening to be enhanced. Further, as shown in the other embodiments of the invention described herein, the light 104 may be eliminated completely.

In the embodiment of FIG. 5, the camera shutter control 90 includes a foot-actuated control 100 mounted on the inside surface 21 of the of the bow portion 24 of the hull 111 at a location accessible to a foot of the human paddler. As discussed above, this foot-actuated control 100 is in communication with the camera shutter control 90 and allows shutter of the camera 102 to be remotely actuated when the paddler (not shown) depresses the foot-actuated control 100.

Figure 6:
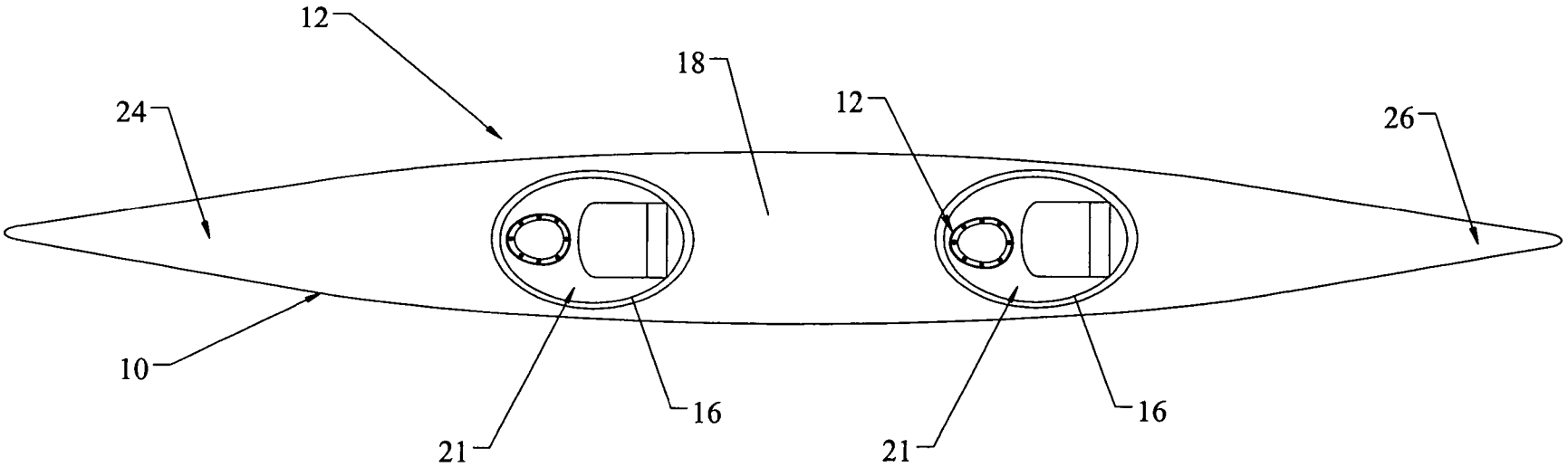
FIG. 6 is a top view of is a top view of a tandem kayak in accordance with the present invention showing the paddler openings and the viewing openings.

Referring now to FIG. 6, a tandem kayak 10 is shown in which a viewing system 12 is mounted to the inside surface 21 of the bottom 20 of hull 11 below each of two paddler openings 16. The viewing systems 12 may take any of the forms shown herein and may be mounted below one or both paddler openings 16. Further, the kayak 10 may have more than two paddler openings 16, with viewing systems 12 mounted below one or more of these openings.

Figure 7:
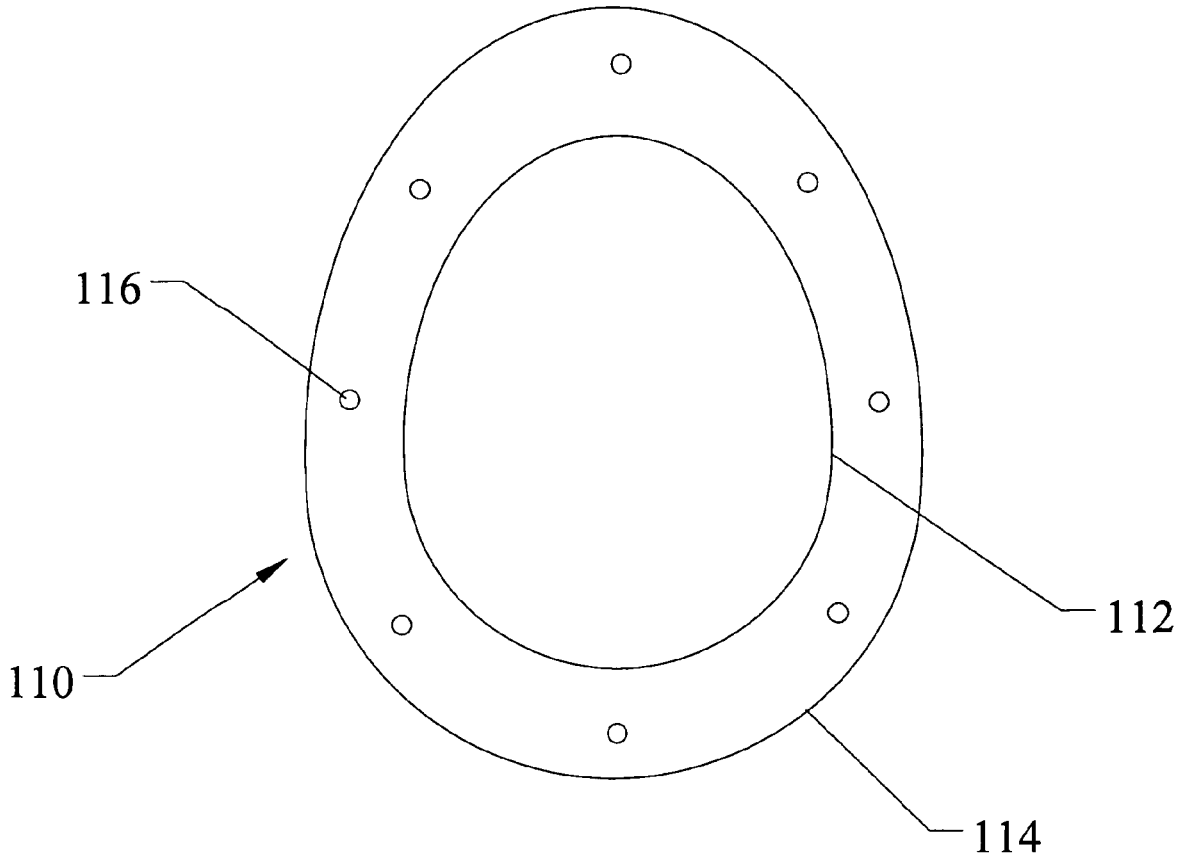
FIG. 7 is top view of the template used in connection with the kit of the present invention.

As discussed above, it is envisioned that the viewing system 12 will be sold in kit form for installation in existing kayaks. These kits will include all of the parts of the viewing system described above, and will also include a template 110 for marking the bottom of the kayak to allow viewing opening and any necessary holes to be properly located. One embodiment of such a template 110 is shown in FIG. 7. This template 110 is preferably manufactured of cardboard, thin plastic, or the like, and includes an inside edge 112 that corresponds to the size of the viewing opening to be cut into the bottom of the kayak, an outside edge 114, which preferably is sized to correspond to the periphery of the viewing system when installed in the kayak. In the embodiment of FIG. 7, the template is intended for use in connection with the viewing system of FIG. 3 and, therefore, includes a plurality of holes 116 that are located to correspond to the holes through the kayak through which the bolts are disposed. However, the template 110 may be manufactured without these holes in embodiments of the kit where bolts are not utilized. The template 110 may also include double-sided tape on one side to allow the template to be held in place while the bottom of the kayak is marked.

The kit of the present invention may only include the parts necessary to install the viewing system, or it may also include the photographic hood, camera mount, foot-actuated control and/or light. However, it is envisioned that the basic kit will only include the parts necessary to install the viewing system and that the other components will be sold separately as aftermarket items for use therewith. In particular, it is envisioned that an add-on photography kit will be sold and that this kit will include the photographic hood, a camera mount designed to fit a particular type or size of camera, a camera shutter control, and the cables necessary to link the camera to the shutter control. This photographic kit has separate applicability to other existing "glass bottom" type watercraft and, when sold apart from the viewing system kit, or used with other viewing systems, is considered to be a separate and distinct invention.

Finally, it is contemplated that both the kayak 10 and kit of the present invention will include scratch resistant covers that mount over the top and/or bottom viewing window during transport and storage.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An improved watercraft, comprising:

a hull comprising a top, a bottom, an inside surface, an outside surface, a bow portion, and a stern portion;

wherein said hull further comprises at least one paddler opening disposed through said top, said paddler opening being dimensioned to allow a human paddler to pass through said opening and sit such that lower extremities of said human paddler are in contact with said inside surface of said bottom of said hull, and such that said human paddler may look downward and see a viewing area formed on said bottom of said hull proximate to said lower extremities; and wherein said hull further comprises at least one viewing opening disposed through at least a portion of said viewing area of said bottom of said hull; and at least one viewing system attached to said bottom of said hull, said viewing system comprising:

a substantially transparent viewing window disposed within said viewing opening through said bottom of said hull, wherein said viewing window comprises a top surface and a bottom surface and has a substantially oblong shape forming photographic portion and a viewing portion, wherein said photographic portion is dimensioned to accommodate a photographic hood, and wherein said viewing portion is dimensioned to allow said paddler to see through said viewing window when the photographic hood is disposed over said photographic portion of said viewing window;

attachment means for attaching said viewing window to said bottom of said hull;

and sealing means for creating a watertight seal between said viewing window and said bottom of said hull.

2. The watercraft as claimed in claim 1 further comprising a photographic hood disposed over said photographic portion of said viewing window.

3. The watercraft as claimed in claim 2 wherein said photographic hood further comprises a camera mount for mounting a camera.

4. The watercraft as claimed in claim 3 further comprising a camera shutter control in communication with said camera mount and adapted to control operation of a shutter of said camera.

5. The watercraft as claimed in claim 4 wherein said camera shutter control comprises a foot pedal mounted on said inside surface of said bow portion of said hull at a location accessible to a foot of said human paddler.

6. The watercraft as claimed in claim 4 further comprising at least one light disposed upon said kayak so as to illuminate an area below said viewing window, wherein said at least one light is in communication with said camera shutter control and wherein said camera shutter control is adapted to energize said light when said camera shutter control is activated.

7. The watercraft as claimed in claim 1 wherein said watercraft is a kayak and further comprising at least one light disposed upon said kayak so as to illuminate an area below said viewing window.

8. The watercraft as claimed in claim 1 wherein said viewing window comprises at least one coating disposed upon at least one of said top surface and said bottom surface thereof.

9. The watercraft as claimed in claim 8 wherein at least one of said at least one coating comprises a glare reducing coating disposed upon said top surface of said viewing window.

10. The watercraft as claimed in claim 1:

wherein said viewing window is dimensioned to overlap a first portion of said inside surface of said bottom of said hull surrounding said at least one viewing opening:

wherein said sealing means comprises a compressible gasket dimensioned to overlap said viewing window, said first portion and a second portion of said inside surface of said bottom of said hull surrounding said at least one viewing opening;

wherein said attachment means comprises a substantially rigid compression member disposed over said gasket and dimensioned to compress said gasket, a plurality of threaded mounting bolts, and a plurality of mounting nuts dimensioned to mate with said mounting bolts;

wherein said compression member, said gasket, and said bottom of said hull surrounding said at least one viewing opening each comprise a plurality of bolt openings disposed therethrough at locations such that said openings form substantially continuous cylindrical bores, and wherein one of said plurality of mounting bolts is disposed through each of said cylindrical bores and one of said mounting nuts is mated with each of said mounting bolts and tightened such that said compression member compresses said gasket.

11. The watercraft as claimed in claim 10 wherein said gasket is manufactured of an closed cell rubber material and said compression member is manufactured of ultra high molecular weight polyethylene material.

12. The watercraft as claimed in claim 1 wherein said watercraft is a kayak and wherein said kayak comprises two paddler openings, wherein said at least one viewing opening comprises two viewing openings, and wherein one of said viewing openings is disposed through said viewing area formed by each of said two paddler openings.

13. The watercraft as claimed in claim 1 further comprising a substantially flexible skirt mounted to said top of said hull and dimensioned to cover at least a portion of said paddler opening.

14. A kit for forming a viewing system in a watercraft, said kit comprising:

a template for marking a bottom of a hull of the watercraft to allow a viewing opening to be formed therein;

a substantially transparent viewing window dimensioned for disposal within said viewing opening through said bottom of said hull, wherein said viewing window comprises a top surface and a bottom surface and has a substantially oblong shape forming photographic portion and a viewing portion, wherein said photographic portion is dimensioned to accommodate a photographic hood, and wherein said viewing portion is dimensioned to allow said paddler to see through said viewing window when the photographic hood is disposed over said photographic portion of said viewing window;

attachment means for attaching said viewing window to said bottom of said hull; and sealing means for creating a watertight seal between said viewing window and said bottom of said hull.

15. The kit as claimed in claim 14 further comprising a photographic hood dimensioned for disposal over said photographic portion of said viewing window.

16. The kit as claimed in claim 15 wherein said photographic hood further comprises a camera mount for mounting a camera.

17. The kit as claimed in claim 16 further comprising a camera shutter control for mounting in communication with said camera mount such that said camera shutter control controls operation of a shutter of said camera.

18. The kit as claimed in claim 17 wherein said camera shutter control comprises a foot pedal dimensioned for mounting on an inside surface of a bow portion of the hull of the watercraft at a location accessible to a foot of said human paddler.

19. The kit as claimed in claim 17 further comprising at least one light disposed upon said watercraft so as to illuminate an area below said viewing window, wherein said at least one light is in communication with said camera shutter control and wherein said camera shutter control is adapted to energize said light when said camera shutter control is activated.

20. The kit as claimed in claim 14 further comprising at least one light dimensioned for disposal upon said watercraft so as to illuminate an area below said viewing window.

21. The kit as claimed in claim 14 wherein said viewing window comprises at least one coating disposed upon at least one of said top surface and said bottom surface thereof.

22. The kit as claimed in claim 21 wherein at least one of said at least one coating comprises a glare reducing coating disposed upon said top surface of said viewing window.

23. The kit as claimed in claim 14:

wherein said viewing window is dimensioned to overlap a first portion of said inside surface of said bottom of said hull surrounding said viewing opening;

wherein said sealing means comprises a compressible gasket dimensioned to overlap said viewing window, said first portion and a second portion of said inside surface of said bottom of said hull surrounding said at least one viewing opening;

wherein said attachment means comprises a substantially rigid compression member dimensioned for disposal over said gasket so as to compress said gasket, a plurality of threaded mounting bolts, and a plurality of mounting nuts dimensioned to mate with said mounting bolts;

wherein said compression member, said gasket, and said template each comprise a plurality of bolt openings disposed therethrough at locations such that said openings form substantially continuous cylindrical bores, and wherein one of said plurality of mounting bolts are dimensioned for disposal through each of said cylindrical bores.

24. The kit as claimed in claim 23 wherein said gasket is manufactured of an closed cell rubber material and said compression member is manufactured of ultra high molecular weight polyethylene material.

25. The kit as claimed in claim 14 further comprising at least one scratch resistant cover for attachment to said viewing system.

26. An improved kayak comprising:

a hull comprising a top, a bottom, an inside surface, an outside surface, a bow portion, and a stern portion;

wherein said hull further comprises at least one paddler opening disposed through said top, said paddler opening being dimensioned to allow a human paddler to pass through said opening and sit such that lower extremities of said human paddler are in contact with said inside surface of said bottom of said hull, and such that said human paddler may look downward and see a viewing area formed on said bottom of said hull proximate to said lower extremities; and wherein said hull further comprises at least one viewing opening disposed through at least a portion of said viewing area of said bottom of said hull; and at least one viewing system attached to said bottom of said hull, said viewing system comprising:

a substantially transparent viewing window disposed within said viewing opening through said bottom of said hull, wherein said viewing window comprises a top surface and a bottom surface;

attachment means for attaching said viewing window to said bottom of said hull;

sealing means for creating a watertight seal between said viewing window and said bottom of said hull; and at least one light disposed upon said kayak so as to illuminate an area below said viewing window.

27. The kayak as claimed in claim 26, further comprising a camera shutter control in electrical communication with said at least one light and adapted to energize said at least one light when said camera shutter control is activated.

* * * * *